United States Patent [19]

Borisoff et al.

[11] Patent Number: 4,643,069

[45] Date of Patent: Feb. 17, 1987

[54] STRING TUNER ATTACHMENT

[76] Inventors: David J. Borisoff; Boris Borisoff, both of 7726 Burnet Ave., Van Nuys, Calif. 91405

[21] Appl. No.: 761,448

[22] Filed: Aug. 1, 1985

[51] Int. Cl.[4] ..... G10D 3/14

[52] U.S. Cl. ..... 84/306; 84/312 R

[58] Field of Search ..... 84/200–208, 84/304–306, 312 R, 312 P

[56] References Cited

U.S. PATENT DOCUMENTS 3,023,658 3/1962 Gusey ..... 84/306

3,674,909 7/1972 Peters et al. ..... 84/312 R 4,515,059 5/1985 Siminoff ..... 84/306

*Primary Examiner*—Lawrence R. Franklin

*Attorney, Agent, or Firm*—William W. Glenny

[57] ABSTRACT

A tuner device for a string instrument such as a guitar including a conventional tuning machine such as one incorporating a worm gear drive for initially tuning a string by controllably rotating the output shaft which has mounted thereon a peg on which a string is wound. The tuning machine is mounted on a support plate assembly which is selectively arcuately rockable through a small angle from its rest position to its operative or detuned position.

8 Claims, 4 Drawing Figures

STRING TUNER ATTACHMENT

BACKGROUND AND SUMMARY OF THE INVENTION

This invention relates generally to string instruments of the guitar family. More particularly it describes an attachment device for a guitar by which a string can be tuned in conventional manner and then, during performance, can be temporarily detuned in a selected degree. This provides a desirable flexibility in performance.

A guitar is generally provided with a tuning machine for each string by which the tension, and thus the pitch, of each string can be adjusted by the user before a performance. A typical tuning machine includes a worm gear drive for rotating an output shaft journaled in the guitar peg head, the shaft having a peg on which the string is wound. The frame of the tuning machine is attached to the guitar peg head, usually by a set of screws.

The present device is intended to be substituted for one of the conventional tuning machines on a guitar. It includes a tuning machine essentially similar to the conventional tuning machine just described, except that it is mounted on a support plate assembly which itself may be rocked arcuately through a small angle about the axis of the output shaft. A base plate provided with a bore through which the output shaft extends is attached to the guitar peg head, preferably by screws or the like received in the openings used by the mounting screws of the original tuning machine which has been removed.

The base plate has pivotally mounted thereon a lever movable between upper and lower positions by the user's finger or thumb. Downward movement of the lever permits the tension of the string to rotate the output shaft and thereby to rock the tuning machine assembly through a small angle about the shaft axis. Stop or limit means are provided for selectively adjusting the amount of angular rocking movement, and thus the amount of lowering of pitch created by the rocking movement. The user can at will move the lever back up to its original or rest position, against the tension of the string, and this cammingly rocks the tuning machine assembly back to its original position.

It is thus an object of the invention to disclose a novel attachment for a string instrument by which to selectively detune a string temporarily to a lower pitch, and to return the string to its original pitch when desired. Other objects will be understood from a study of the following description of an illustrative form of the invention taken in connection with the accompanying drawings.

DETAILED DESCRIPTION

The present string tuner device will be described first with reference to FIG. 1. The parts are there shown in expanded relation with the peg head of a conventional guitar indicated generally at 10, the original tuning machine in the first location having been removed. The other original tuning machines, typically three more in number, remain unaffected by the substitution of the present device in place of the removed tuning machine. The present device includes a base plate indicated generally at 12 which may be mounted by suitable fasteners 14 threadedly received in openings 15 in the peg head registering with bores 16 extending through the base plate. It will be understood that the openings 15 in the peg head are desirably the existing openings used for attaching one of the original tuning machines to the peg head. This avoids disfiguring the peg head in attaching the present tuner device to the peg head.

Figure 1:
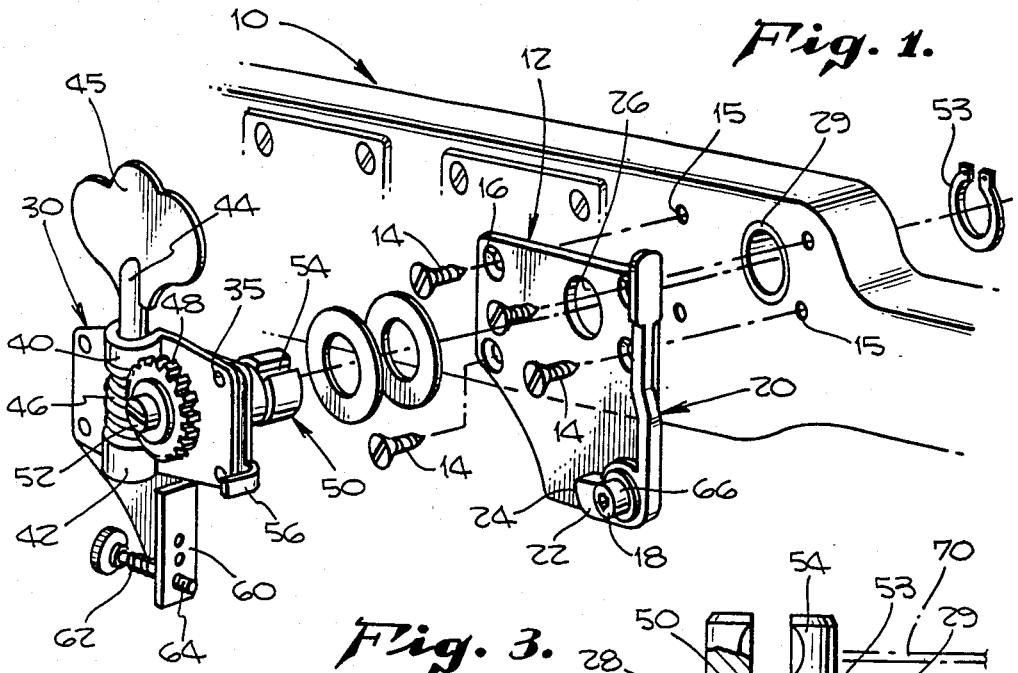
FIG. 1 is an exploded perspective view of the present device, together with a fragmentary portion of a guitar peg head on which the device is mounted, and also showing fragmentarily the upper edge portions of the base plates of several conventional tuning machines mounted on the peg head.
Figure 2:
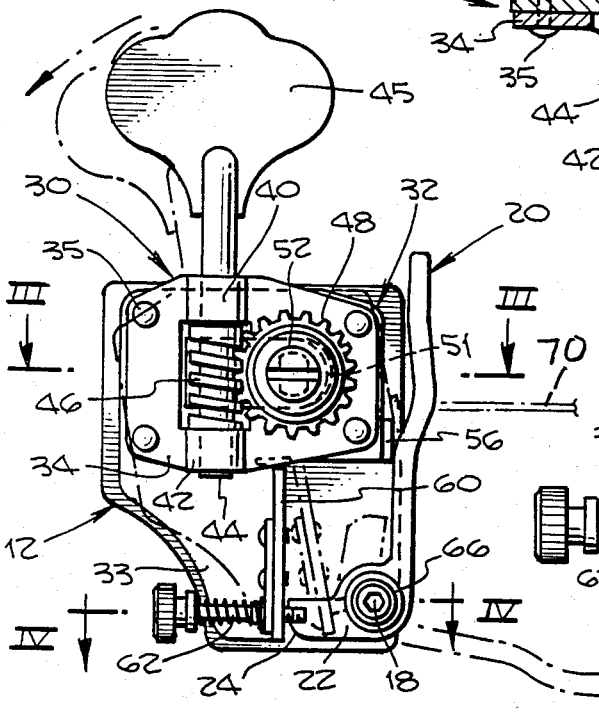
FIG. 2 is a side view of the device showing the thumb lever and other parts in solid lines in their rest positions and in dotted outline in their operative or detuning position and showing the string fragmentarily and in dotted outline, to avoid interference with the clarity of the drawing.

Near the lower right corner of the base plate as seen in FIGS. 1 and 2, there is pivotally attached at 18 a thumb lever indicated generally at 20. The thumb lever is arcuately movable by the user in a plane parallel to the base plate between an upper position shown in solid lines and a lower position shown in dotted outline. Thumb lever 20 has, preferably formed integrally, a short camming finger 22 projecting from the pivotal axis 18 perpendicular to the longitudinal axis of the thumb lever itself. As will be later explained, when the thumb lever is digitally moved upwardly, cam finger 22, through its outer smoothly curved camming surface 24 eccentric to the pivotal axis 18, cammingly forces the rockable parts, against the force of the string tension, from their detuned or operative positions to their rest positions.

Figure 3:
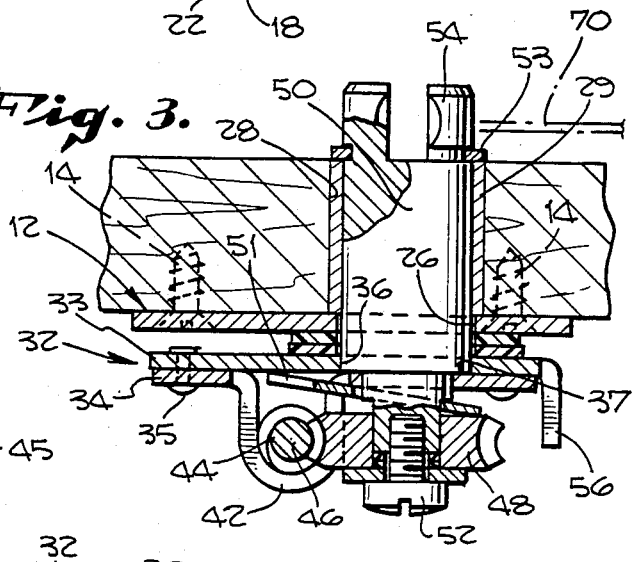
FIG. 3 is a sectional view taken on arrows III—III of FIG. 2 showing the device mounted on the guitar peg head, with the string shown fragmentarily and in dotted outline.

The base plate 12 is provided with an enlarged bore 26 extending therethrough. When the base plate is mounted on the peg head 10, as best seen in FIG. 3, the base plate bore 26 registers with the existing bore 28 in the peg head, desirably provided with a bushing 29.

Outwardly of base plate 12 from peg head 10 is a tuning machine assembly indicated generally at 30. As best seen in FIG. 3, assembly 30 includes a support plate assembly 32, made up of inner and outer component plates 33 and 34 retained in laminated relation by fasteners such as rivets 35. The two component plates are concentrically apertured at 36. The diameter of the aperture or bore in outer plate 34 is smaller than that of the bore in inner plate 33, thus forming an inwardly directed annular shoulder 37 in the outer plate. Both bores are coaxially aligned with peg head bore 28.

Outer plate 34 is provided with a pair of integrally formed upper and lower straps 40 and 42, which serve to loosely journal an upright shaft 44 having an upper thumb handle 45, and carrying a worm 46 between the journaling straps. Worm 46 meshes in known manner with worm wheel or gear 48, which is mounted on and keyed to a shaft indicated generally at 50 and held thereon by conventional means 52. Worm gear 48, and shaft 50, are biased downwardly as seen in FIG. 3 by resilient means here shown as leaf spring washer 51. A shoulder on shaft 50 bears downwardly against annular shoulder 37 on outer plate 34. Shaft 50 is journaled in bushing 29 in the peg head, and is retained in place by a conventional snap ring 53 received in a groove in the shaft. The innermost end of shaft 50 projects beyond the peg head, and is provided with a slotted peg 54 of known design on which a string 70 is wound.

It will be understood that manual rotation of thumb handle 45 by the user serves to tune string 70 wound on peg 54.

Means are provided in accordance with the invention for selectively rocking the tuning machine assembly 30 about the axis of shaft 50. Such means include the cam finger 22 of the pivotally mounted thumb lever 20 previously described, and a cooperating abutment member or cam follower carried by the tuning machine assembly. The cam follower is here shown as an outwardly projecting bracket 60 carried by the lower right corner of inner component plate 33. When thumb lever 20 is moved to its lower position, the camming relationship between bracket 60 and the camming surface 24 of the thumb lever permits the tension of string 70 to slightly rotate shaft 50 counterclockwise and thus to rock the assembly 30 from its higher pitch position seen in solid lines in FIG. 2, to its lower pitch or detuned position seen in dotted outline.

Figure 4:
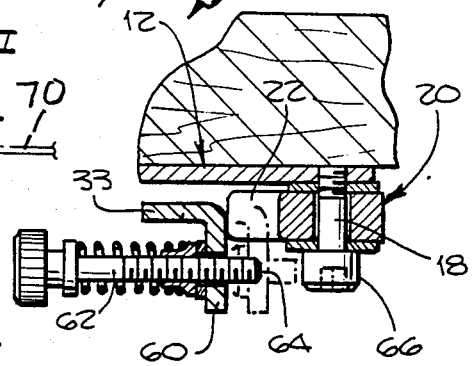
FIG. 4 is a sectional view taken on arrows IV—IV of FIG. 2 showing details of the adjustable stop member.

Means are provided for selectively limiting the amount of counterclockwise rocking movement of the tuning machine, and thereby controlling the lower pitch to which the string can be selectively detuned by the present device. Such means are here shown as a selectively adjustable thumb screw 62 threadedly received in bracket 60. As best seen in the lower part of FIG. 4, the inner tip 64 of screw 62 is abuttable against a nut 66 mounted on the shaft providing the pivotal axis 18 for the thumb lever 20. Thus when the thumb lever is in its lowermost position, the position of screw tip 64 controls the amount of rotation of the tuning machine from its rest position, and thus determines the amount of change of pitch of the string.

In order to restore the parts to their normal or rest positions, the user moves thumb lever 20 upwardly back to its inoperative or rest position. This movement causes cam 24 to force the rockable parts in a clockwise direction, against the string tension force. Stop member 56 limits upward pivotal movement of the thumb lever.

What is claimed is:

1. A tuner attachment for the peg head of a guitar having a string whose tension controls its pitch comprising:

a tuning machine having an output shaft journaled in the peg head and provided with an extension on which said string is wound;

and means for arcuately rocking the tuning machine about the axis of the shaft between a rest position and an operative position.

2. The invention as defined in claim 1 wherein said rocking means includes camming means rotatable about an axis spaced from said shaft axis.

3. The invention as defined in claim 2 wherein the rocking means includes a digitally movable lever for actuating the camming means.

4. The invention as defined in claim 3 wherein said lever and the camming means are rotatable about a common axis.

5. The invention as defined in claim 1 wherein said rocking means includes a base plate adapted to be mounted on the peg head.

6. The invention as defined in claim 5 wherein the peg head has provided therein existing openings for fastening means and the base plate is fastened to the peg head by fastening means received in said existing openings.

7. The invention as defined in claim 1 including stop means for establishing the operative position.

8. The invention as defined in claim 7 including means for selectively adjusting the position of the stop means.

* * * * *